US006595440B2

(12) United States Patent
Moriarty et al.

(10) Patent No.: US 6,595,440 B2
(45) Date of Patent: Jul. 22, 2003

(54) HANDHELD FLUID POWERED SPRAY DEVICE WITH DETACHABLE ACCESSORIES

(76) Inventors: Brian P. Moriarty, 22908 SE. 192nd St., Maple Valley, WA (US) 98038; Brett J. Carter, 15061 176th Ave. SE., Monroe, WA (US) 98272; Edward A. Uhl, 2550 3rd Ave., #725, Seattle, WA (US) 98121

( * ) Notice: Subject to any disclaimer, the term of this patent is extended or adjusted under 35 U.S.C. 154(b) by 25 days.

(21) Appl. No.: 09/844,168

(22) Filed: Apr. 27, 2001

(65) Prior Publication Data

US 2002/0158143 A1 Oct. 31, 2002

(51) Int. Cl.[7] ..... B05B 3/00; B05B 3/04; B05B 7/02; B05B 9/01; A62C 31/02

(52) U.S. Cl. ..... 239/226; 239/237; 239/240; 239/390; 239/526

(58) Field of Search ..... 239/525, 226, 239/237, 240, 390, 391, 225.1, 526; 15/29

(56) References Cited

U.S. PATENT DOCUMENTS 1,097,410 A * 5/1914 Flack et al. ..... 15/24
2,602,698 A * 7/1952 Wyckoff ..... 239/312
2,678,457 A * 5/1954 Demo et al. ..... 15/29
3,581,998 A * 6/1971 Roche ..... 239/310
4,370,771 A * 2/1983 Gonzalvo ..... 15/29
4,374,444 A * 2/1983 Zhadanov ..... 15/29
4,461,052 A * 7/1984 Mostul ..... 137/625.13
4,471,503 A * 9/1984 Smyth ..... 15/22.1
4,513,466 A * 4/1985 Keddie et al. ..... 15/29
4,679,270 A * 7/1987 Gaiti et al. ..... 15/29
4,720,883 A * 1/1988 Sanchez ..... 15/29
4,780,922 A * 11/1988 Sanchez ..... 15/29
5,129,121 A * 7/1992 Gelman ..... 15/29
5,619,766 A * 4/1997 Zhadanov et al. ..... 15/29
5,716,005 A * 2/1998 McMahan ..... 239/305
5,906,319 A * 5/1999 Crowl ..... 239/310
6,000,626 A * 12/1999 Futo et al. ..... 239/333
6,170,108 B1 * 1/2001 Knight ..... 15/29

* cited by examiner

*Primary Examiner*—Michael Mar
*Assistant Examiner*—Darren Gorman

(57) ABSTRACT

A handheld water powered spray device is provided that is comprised of a cleaning agent reservoir and a cleaning agent and water mixture control, that is capable of receiving detachable accessories, and that provides a water powered output source to power the detachable accessories in either a rotating or linear motion. The water powered spray device of the present invention also provides user controls for controlling the output power and for spraying water onto an object without powering of the attached accessory.

19 Claims, 7 Drawing Sheets

HANDHELD FLUID POWERED SPRAY DEVICE WITH DETACHABLE ACCESSORIES

BACKGROUND OF THE INVENTION

This invention relates to a fluid spray device, in particular, to a handheld water powered spray device having detachable accessories.

Conventional water spray devices are in widespread use in many household, commercial and industrial applications. For example, in the household, spray devices are in use in kitchens and bathrooms for spraying items in the kitchen sink or washing the bathroom shower. There are also many spray devices designed for adaptation to garden hoses for watering plants and the like, washing cars, driveways and the outside of a house or building. Spray devices are also used for cleaning applications in industrial and commercial settings such as restaurants or factories.

Many conventional water spray devices perform only the function of spraying water in a single pattern. Some conventional water spray devices permit the user to change the spray pattern of the spray device by providing a multi-ported or variable patterned spray head.

Another feature employed in many spray devices is the use of a reservoir on or in the spray device itself that permits the introduction of liquid cleaning agents such as soap into the water stream. Other spray devices use water as power to drive a transmission for rotating a brushing device fixed to the end of the spray device. Such transmissions are typically turbine like devices, which are rotated by water jets directed at blades on the turbine. The turbine is in most cases coupled to a gearing arrangement that in turn rotates the brushing device. Some water powered spray devices are designed to evacuate the water from the chamber holding the turbine and gear arrangement while other spray devices allow the turbine and gear arrangement to remain submerged in the chamber.

A majority of spray devices utilizing turbines or the like have the drawback of being very large and cumbersome because they are designed for applications such as washing floors, automobiles, boats, buildings and cannot be fully operated with a single hand. Although such devices must typically be held by both hands of the user to operate, they are not handheld devices within the sense of the present invention because the user cannot operate all features of the device with the single hand holding the device.

In addition, the brushing devices of existing water powered spray devices are not easily removable from the body holding the brushing device. No water powered devices are known having detachable accessories that provide either rotational motion or linear motion.

Water spray devices used in kitchens and bathrooms also have several drawbacks. For example, spray devices used in kitchens typically provide a spray only mode. Some spray devices used at kitchen sinks provide an internal soap reservoir and permit the user to attach a brushing device to the head of the water spray device. However, in such devices neither water, soap or a water soap mixture is directed into the brush head but rather from and through the spray head of the spray device. Moreover, no apparatus for rotating the brushing device is provided in such devices.

In the operation of a water spray device having a soap reservoir and a non-rotating brush, a user may first spray water on the item to be washed. After the item is wetted, the user may then dispense soap directly onto the application in the same manner as a plastic soap bottle is squeezed. After the soap has been applied to the item, the operator must manually scrub the item by using stroking motions.

If the user desires to add additional water to the application to aid in foaming of the soap, the user would have to pull the single trigger to spray more water onto the item being washed. Such operation causes the soap to be rinsed off and the sprayed water to be deflected off the item itself and onto the user or surrounding environment. In addition, the user may have to repeat the foregoing process several times to reach the desired soap to water ratio or foaming result.

Accordingly, it is desirable to have a handheld water powered spray device that provides a soap reservoir and a soap water mixture control, that is capable of receiving detachable accessories, and that provides a power output source available to power the detachable accessories in either a rotational or linear motion.

BRIEF SUMMARY OF THE INVENTION

In accordance with the principles of the present invention, a handheld water powered spray device is provided that comprises a soap reservoir and a soap water mixture control, is capable of receiving detachable accessories, and provides a water powered output source to power the detachable accessories in either a rotational or linear motion.

DETAILED DESCRIPTION OF THE INVENTION

Figure 1:
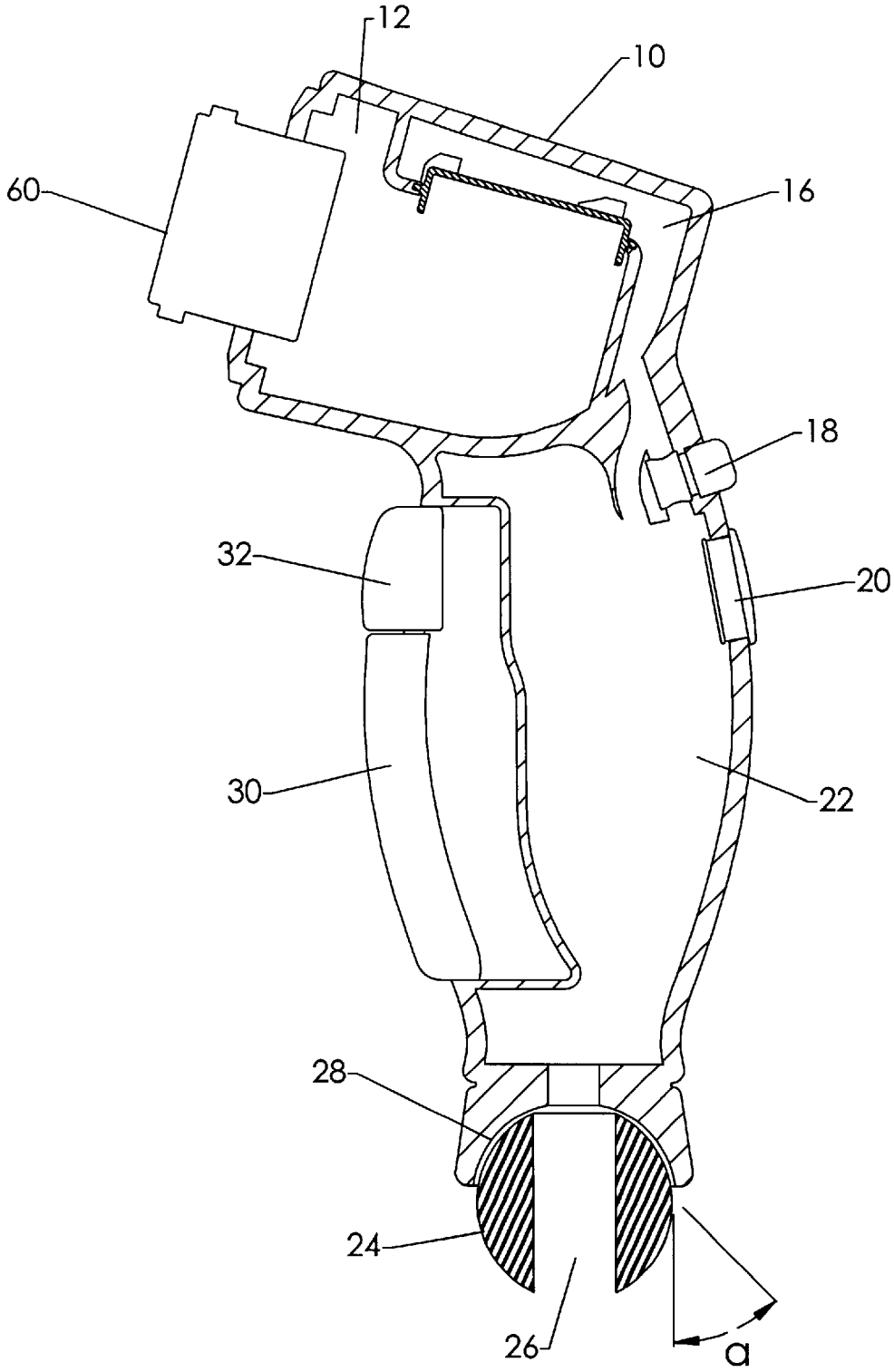
FIG. 1 illustrates a cross sectional view of the body of the present invention.

Referring first to FIG. 1, a body 10 is shown having a transmission chamber 12, pressurized wash chamber 16, agent valve 18, agent fill cap 20, agent reservoir chamber 22, swivel hose adapter 24, wash trigger 30, spray trigger 32, and output nozzle 60. A sight glass (not shown) may also be provided in body 10 to show the level of agent in the agent reservoir chamber 22.

Swivel hose adapter 24 is fitted to socket 28 using known sealed ball and socket technology to provide a user with both rotational and swinging motion of the hose within the socket. For example, swivel hose adapter 24 may be rotated 360 degrees within socket 28 and swiveled or rocked 15 to 30 degrees within socket 28 as shown by arrow a. Swivel hose adapter 24 is shown having water inlet 26 for channeling pressurized water to the spray device. Swivel hose adapter 24 or body 10 may house an optional inline pressure regulator (not shown) to regulate the pressure of the water being supplied to the device. In operation, the opposing end (not shown) of swivel hose adapter 24 will be attached to a flexible hose (not shown) that will in-turn be attached to a pressurized water supply source such as household plumbing or the like (not shown). If a faucet or the like is coupled to the same pressurized fluid source as the spray device of the present invention is coupled to, then a standard off-the-shelf shut-off accessory may be applied to the exit port of existing faucet heads such that water will be conserved during operation of the present invention.

Figure 2A:
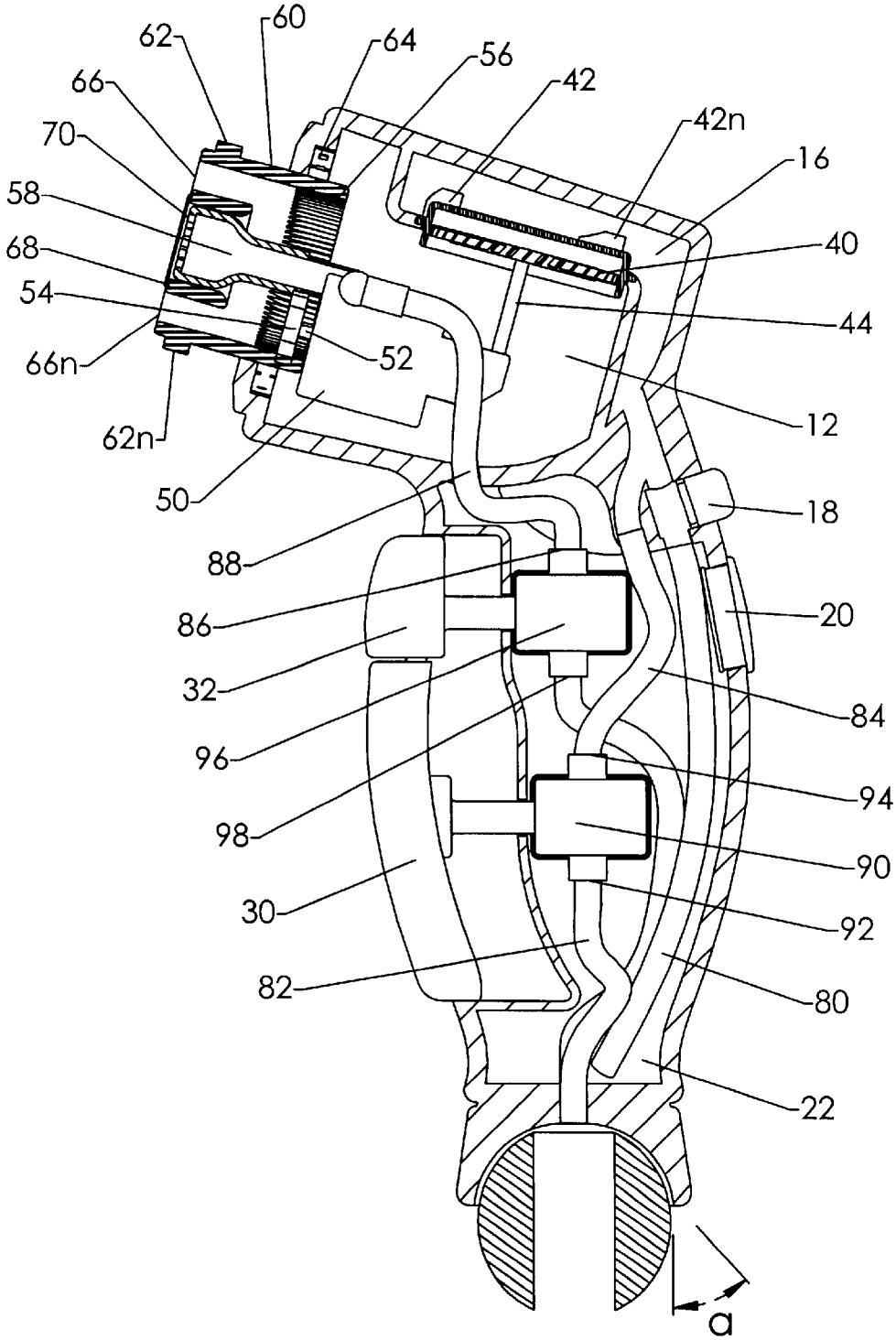
FIGS. 2*a* and 2*b* illustrate a cross sectional and frontal view of components of a water spray device constructed in accordance with the principles of the present invention.

Turning now to FIG. 2*a*, the details of a water spray device constructed in accordance with the principles of the present invention is shown.

Agent reservoir 22 is shown having agent pick-up tube 80, agent fill cap 20 and agent valve 18. Agent fill cap 20 covers an opening in body 10 to allow the user to load agent reservoir 22 with an agent and to prevent leakage of the agent once loaded. Pick-up tube 80 siphons the agent loaded in reservoir 22 and channels it to agent selector switch 18, which determines, based on the user setting, whether the agent will be introduced into pressurized wash chamber 16 to mix with the pressurized water supply. In a preferred embodiment of the present invention, agent valve 18 is a multi-position valve having an in-line check valve for allowing agent flow into supply chamber 16 and for preventing pressurized water from entering into reservoir chamber 22. One skilled in the art will readily recognize that a variable valve may be used rather than a multi-position valve. In addition, other well-known methods for siphoning or delivering the agent to the pressurized wash chamber may be used. The spray device of the present invention is designed such that the user can easily hold body 10, operate wash trigger 30, operate rinse trigger 32, and operate agent valve 18 with a single hand.

Agent reservoir chamber 22 is also shown having supply channel 82, wash channel 84, rinse channel 88, wash valve 90 and rinse valve 96. Supply channel 82 is shown connected to wash valve inlet 92 and rinse valve inlet 98. Wash valve outlet 94 is shown connected to wash channel 84, which provides a path for pressurized water to enter pressurized wash chamber 16. Rinse valve outlet 86 is shown connected to rinse channel 88, which provides a path for water to enter rinse outlet port 58. Although wash valve 90 and rinse valve 96 are shown as separate valves with separate supply channels, one skilled in the art will readily recognize that a single supply channel or a single valve configuration may be used to accomplish the same functions of the wash and rinse valves.

In a preferred embodiment of the present invention, wash valve 90 and rinse valve 96 are variable on/off valves set to the normally off position. For example, if a user applies a small amount of pressure to wash trigger 30, a small amount of pressurized water will flow through the wash valve. Similarly, if a user applies an increased amount of pressure to wash trigger 30, an increased amount of pressurized water will flow through the wash valve. No flow will occur in either valve until pressure is applied to the trigger. One skilled in the art will readily recognize that wash valve 90 and/or rinse valve 96 may also be a multi-position valve.

Turning now to pressurized wash chamber 16, water jets 42 are shown directed at turbine 40. Turbine shaft 44 is securely fixed to turbine 40. Turbine 40 is a circular device having blades or fins (not shown) in the outer diameter of the turbine and angled or cupped such that water projected from water jet 42 will rotate turbine 40 and shaft 44 when it impacts the blades. Water jets 42 have hollowed cylindrical inner diameters (not shown) which are sized to project the pressurized water or water agent mixture onto the blades of turbine 40 in a high velocity compact stream. Water jets 42 are also sized to obtain the desired rotational speed and output torque of output nozzle 60 as discussed below with minimal water consumption. The hollowed cylindrical inner diameters (not shown) of water jets 42 may also be shaped such that the inlet to such inner diameter is larger than the outlet of such inner diameter. In such a shape, the inner diameter is cone shaped, wherein the large end of the cone is located at the inlet.

The water jets 42 and turbine 40 are positioned to displace and expel the water efficiently to reduce hydrodynamic drag if the turbine becomes partially or fully submerged. If turbine 40 becomes fully submerged during operation the output torque and rotational speed will be reduced in proportion to the hydrodynamic drag placed on the turbine. Although performance of the spray device will be hindered in such cases, the output nozzle will continue to operate in accordance with the principles of the present invention. An optional filter (not shown) may be placed in the fluid stream prior to the jets such that unwanted particles will not reach and clog the water jets.

Transmission chamber 12 is shown with transmission 50, which in a preferred embodiment of the present invention is a sealed unit having a series of planetary gears (not shown) positioned inside of the unit and coupled to turbine shaft 44. The planetary gears are sized and arranged to provide a rotational speed range of 100 to 130 revolutions per minute ("RPM") and a torque output of 3 to 5 inch-pounds with a water supply pressure of 30 to 60 pounds per square inch ("PSI"). Those skilled in the art will readily recognize that other well known gear configurations and ratios such as spur and pinion gears may also be used.

Figure 2B:
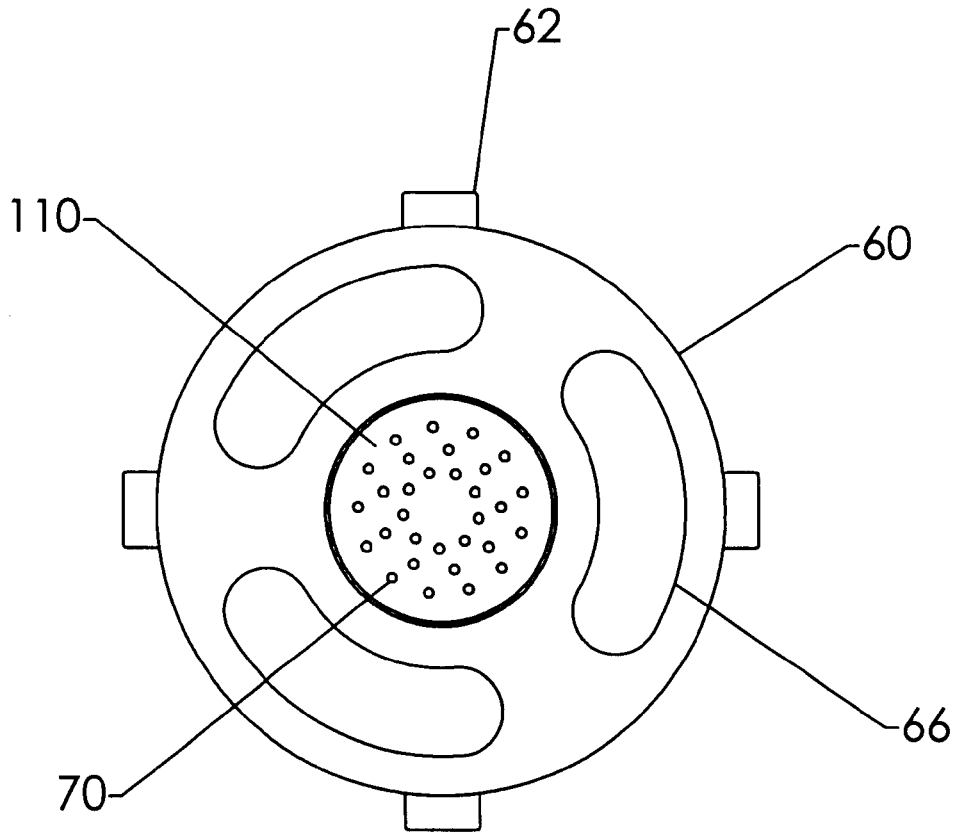

Transmission 50 is shown having output shaft 52. Output shaft 52 is fixed to pinion gear 54, which is matched to and mates with spur gear 56 of output nozzle 60. Output nozzle 60 is also shown with rinse port 58, keys 62, exit ports 66, o-ring 68, and spray ports 70. Rinse port 58 provides a channel for pressurized water delivered from rinse valve 96 and channel 88 to be projected through spray ports 70, which may be arranged to create a spray pattern as can be seen in FIG. 2*b*, for example.

Exit ports 66 are shown on the interior portion of output nozzle 60 as circular shaped ports but may also be slot shaped ports, having one constant slot or several slots spanning the length of the interior of output nozzle 60. Keys 62 are shaped to mate with key slots 114 as described below. Output nozzle 60 rotates freely about bearing 64, which will also seal the gap between transmission chamber 12 and output nozzle 60 using well known bearing and journal sealing techniques.

Figure 3A:
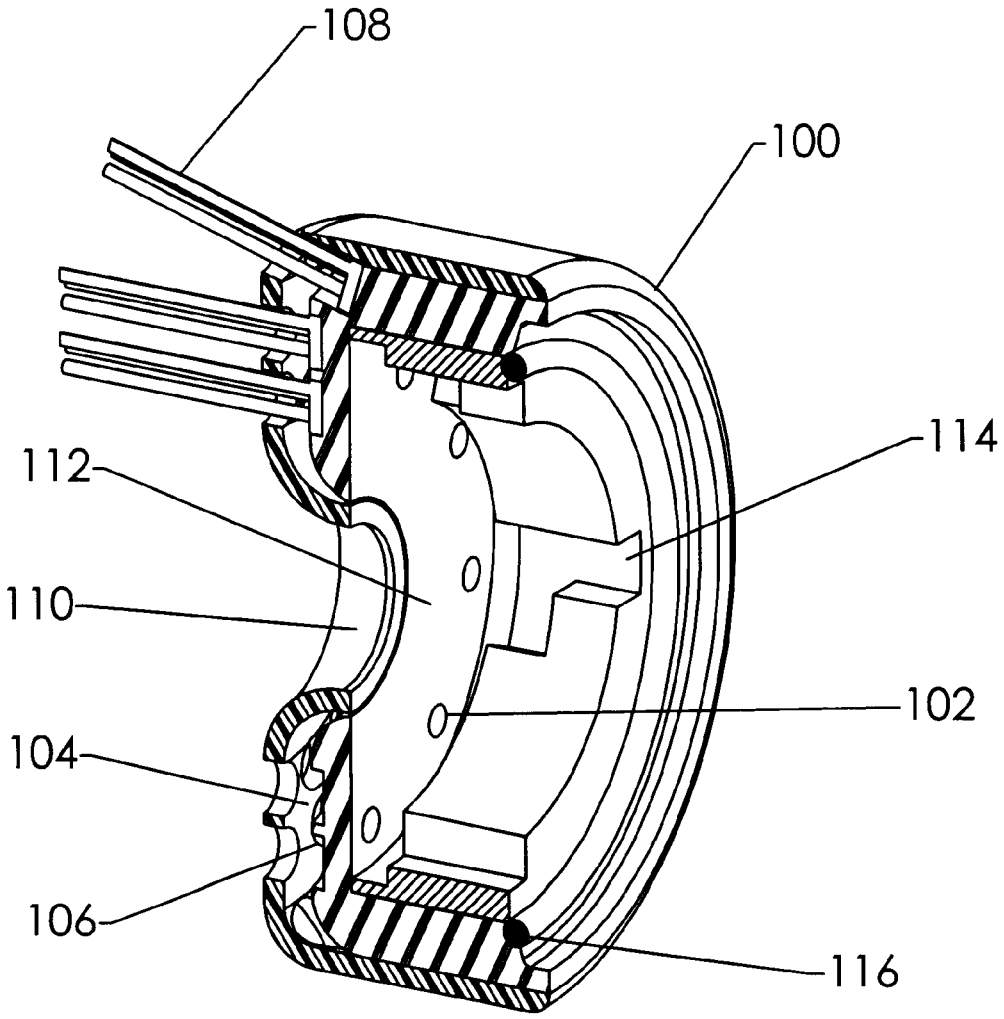
FIGS. 3*a* and 3*b* illustrate a cross sectional and frontal view of a rotating detachable accessory constructed in accordance with the principles of the present invention.

Turning now to FIG. 3*a*, a cross sectional view of a detachable accessory of a water spray device constructed in accordance with the principles of the present invention is shown. Brush head 100 is shown having a series of fluid entry ports 102, a fluid cavity 104, fluid exit ports 106, bristles 108, opening 110, o-ring seat 112, key slot 114 and o-ring 116. As set forth in the description above regarding exit ports 66, fluid entry ports 102 and fluid exit ports 106 may be slot shaped ports, having one constant slot or several slots.

As water or a water/agent mixture flows through exit ports 66, it will be directed through fluid entry ports 102 into cavity 104 and through fluid exit ports for application to bristles 108. In a preferred embodiment of the present invention, bristles 108 are constructed of nylon fibers having flexibility and strength appropriate to withstand scrubbing action caused by the rotation of output nozzle 60. Bristles 108 may also be constructed of other materials such as copper, aluminum or the like, wire strands to increase the strength of the bristles for more demanding cleaning or scrubbing applications. Bristles 108 may also be substituted with other materials such as synthetic sponges, abrasive pads and the like. Bristles 108 and brush head 100 may be constructed to be washed with a wash machine or by hand.

Key slots 114 are positionally and dimensionally matched to fit snugly with keys 62 to provide a detachable locking action of brush head 100 to output nozzle 60. Key slots 114 are shown as "L" shaped but may be of any shape that provides such a detachable locking action. Brush head 100 is also shown with o-ring 116, however one skilled in the art will readily recognize that individual o-rings may be placed around fluid entry ports 102. Opening 110 is sized and positioned to allow unrestricted fluid flow from spray ports 70 of output nozzle 60.

Figure 3B:
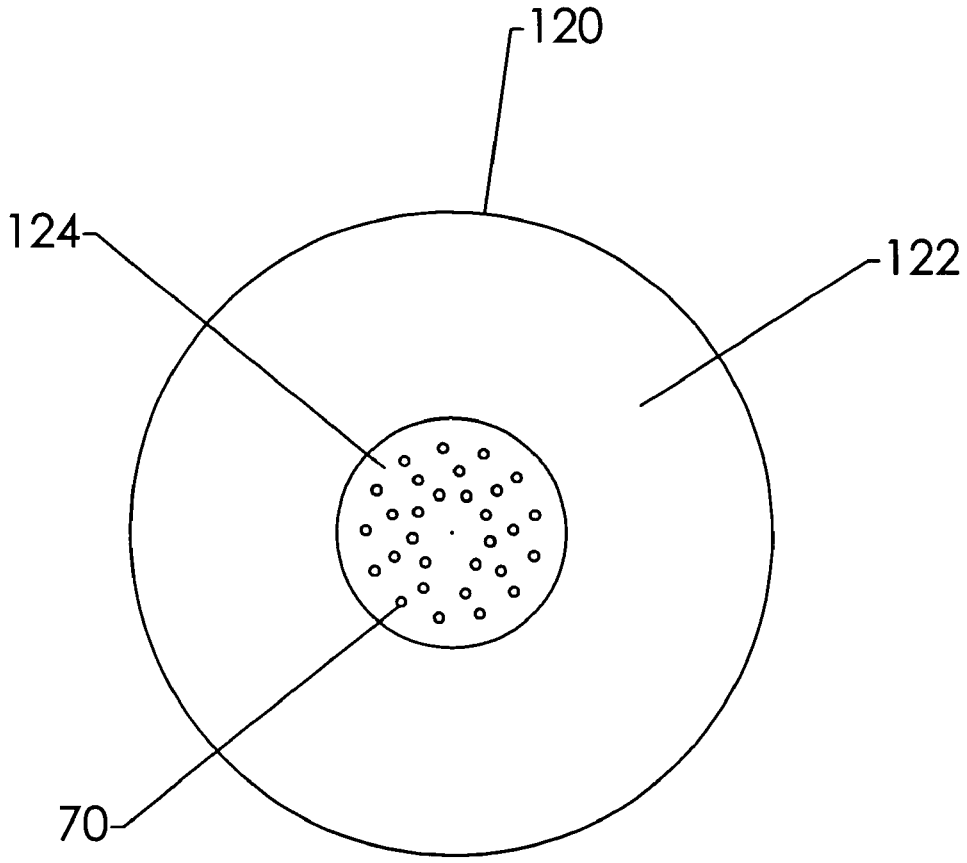

Turning now to FIG. 3*b*, a front view of a detachable accessory constructed in accordance with the principles of the present invention is also shown. Spray head 120 is shown with face 122 and opening 124. Spray head 120, houses key slots (not shown) similar to those shown in FIG. 3*a* such that spray head 120 may be detachably connected to output nozzle 60. Spray ports 70 of output nozzle 60 are also shown through opening 124. Like opening 110, opening 124 is sized to allow unrestricted fluid flow from spray ports 70 of output nozzle 60.

In operation of the water powered spray device of the present invention, swivel hose adapter 24 is connected to a pressurized fluid source (not shown) such as a household water supply line found in most homes. As pressurized water enters supply inlet 26 it will travel through supply channel 82 to pressurize wash valve 90 and rinse valve 96. Once wash valve 90 and rinse valve 96 are pressurized, the user may choose one of three modes of operation: wash with agent, wash without agent, or rinse mode.

In rinse mode, when the user applies pressure to rinse trigger 32, rinse valve 96 will open and allow the pressurized water to flow through channel 88 to rinse port 58 located within output nozzle 60. The pressurized water will then exit though spray ports 70 in a pattern determined by the arrangement of the spray ports on rinse port 58. The spray pattern will travel through opening 110 of brush head 100. FIG. 2*b* shows one of numerous spray pattern arrangements.

In wash mode, when the user applies pressure to wash trigger 30, the pressurized water at wash valve 90 to enter wash channel 84, which will supply pressurized water to wash chamber 16. If agent selector switch 18 is in the "on" position, the agent (not shown) in agent reservoir 22 will be siphoned through pick-up tube 80 and will be mixed into the water in wash chamber 16. If the agent selector switch is in the "off" position then no agent will be supplied to wash chamber 16.

The pressurized water and/or water-agent mixture from supply chamber 16 will be forced through water jets 42. Since the inner diameter of water jets 42 has a small diameter, the pressurized water will flow through the water jets and will be projected onto the turbine blades in a high velocity compact stream, thus, rotating the turbine. As turbine 40 is rotated, turbine shaft 44 will rotate at the same number of RPM. As the fluid projected onto the turbine blades is expelled off of the turbine blade, the expelled water or water-agent mixture will drain through exit ports 66 while output nozzle 60 rotates.

As turbine shaft 44 rotates, the gears (not shown) located inside of transmission 50 will transfer the rotating energy to output shaft 52 and pinion gear 54, which will in turn rotate spur gear 56 and output nozzle 60. As output nozzle 60 rotates, the attached detachable accessory will rotate at the same rate.

If brush head 100 is attached to output nozzle 60, then water or water/agent mixture will flow or drain through exit ports 66, through fluid entry ports 102 and fluid exit ports 106 through bristles 108. Thus providing the user with a rotating handheld device with a water or water/agent mixture traveling through bristles 108, while brushing head 100 rotates at a speed determined by the pressure applied to wash trigger 30.

Figure 4A:
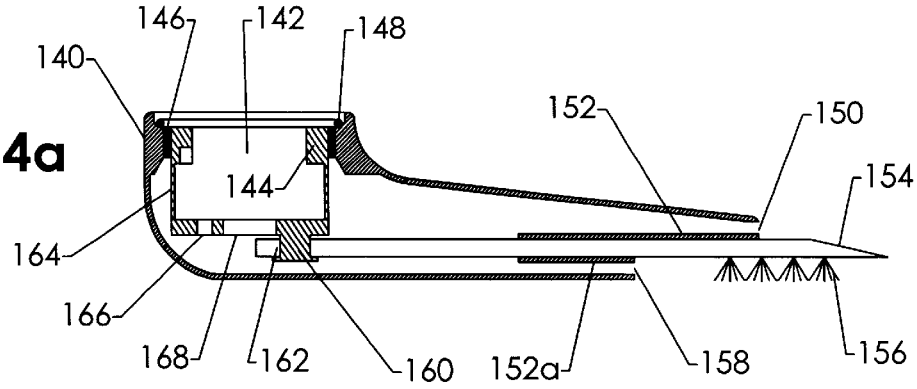
FIGS. 4*a*, 4*b* and 4*c* illustrate a cross sectional side view, and top and bottom views of a linear motion detachable accessory constructed in accordance with the principles of the present invention.
Figure 4B:
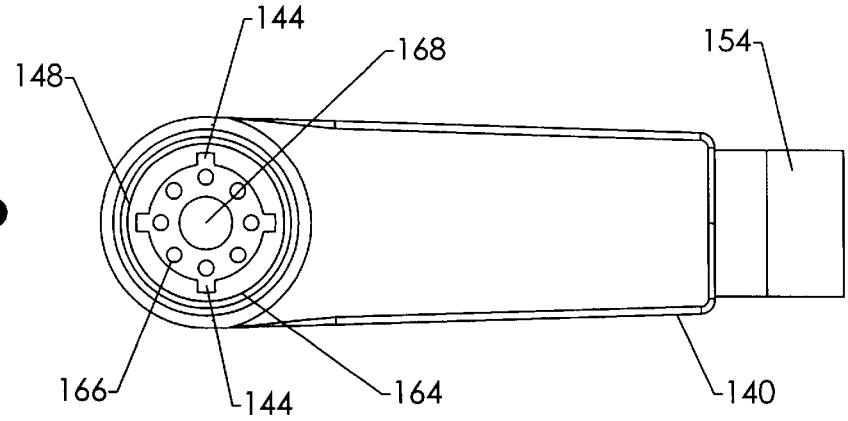
Figure 4C:
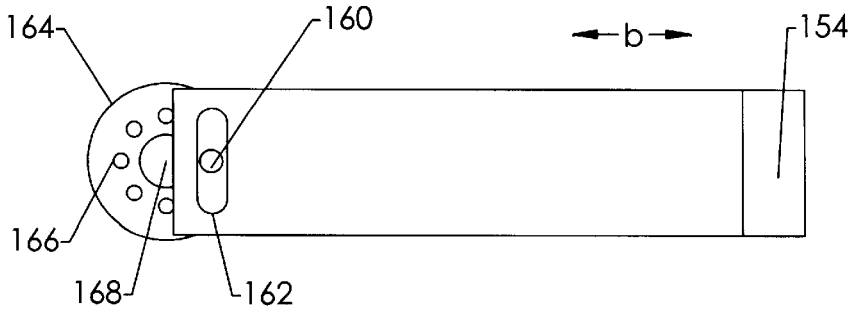

Turning now to FIGS. 4*a*, 4*b* and 4*c*, a cross sectional side view and a top and bottom view of a linear based detachable accessory constructed in accordance with the principles of the present invention is shown. Linear accessory 140 is shown having an attachment opening 142, key slots 144, bearing 146, o-ring 148, linear exit ports 150 and 158, blade 154, blade bristles 156, pivot pin 160, translation slot 162, translation housing 164, linear ports 166 and linear opening 168.

Similar to key slots 114 (See FIG. 3*a*) key slots 144 are positionally and dimensionally matched to fit snugly with keys 62 (See FIG. 2*a*) to provide a detachable locking action of linear accessory 140 to output nozzle 60 (See FIG. 2*a*).

Attachment opening 142 and translation housing 164 are dimensionally matched to receive output nozzle 60. Translation housing 164 is shown with linear ports 166 and linear opening 168. Linear ports 166 are sized and positioned to allow unrestricted fluid flow from exit ports 66 (See FIG. 2*a*). Linear opening 168 is sized and positioned to allow unrestricted fluid flow from spray ports 70 (See FIG. 2*a*) of rinse port 58. Linear accessory 140 is shown with o-ring 148, which provides the necessary friction to prevent the accessory from rotating with output nozzle 60.

In FIG. 4*a*, blade 154 is shown with translation slot 162. Pivot pin 160 is coupled to translation slot 162 such that it may move freely within slot 162. Pivot pin 160 is securely fixed to and positioned on translation housing 164. From FIG. 4*c*, it can be seen that the rotation of translation housing 164 will cause blade 154 to move in the direction of arrow b, while pivot pin slides back and forth within translation slot 160.

As translation housing 164 rotates it will rotate freely within bearing 146. Bearing 146 is constructed similar to bearing 64 (See FIG. 2*a*) using well-known bearing and journal sealing techniques. As blade 154 moves it will slide between bearing plates 152 and 152*a*.

During operation, fluid or a fluid agent mixture exiting from linear ports 166 and linear opening 168 will flow through and out linear exit ports 150 and 158. Blade 154 is shown having bristles 156. In a preferred embodiment of the present invention, bristles 156 are constructed of nylon fibers having flexibility and strength appropriate to withstand scrubbing action caused by the linear motion of blade 154. Like bristles 108 (See FIG. 3*a*), bristles 156 may also be constructed of other materials such as copper, aluminum or the like, to increase the strength of the bristles for more demanding cleaning or scrubbing applications. Bristles 156 may also be substituted with other materials such as synthetic sponges, abrasive pads and the like. Bristles 156 and linear accessory may be constructed to be washed with a wash machine or by hand.

In a preferred embodiment of the present invention, blade 154 is constructed of plastic material such as delron, teflon or the like, or alloys such as brass, aluminum or the like.

Figure 5:
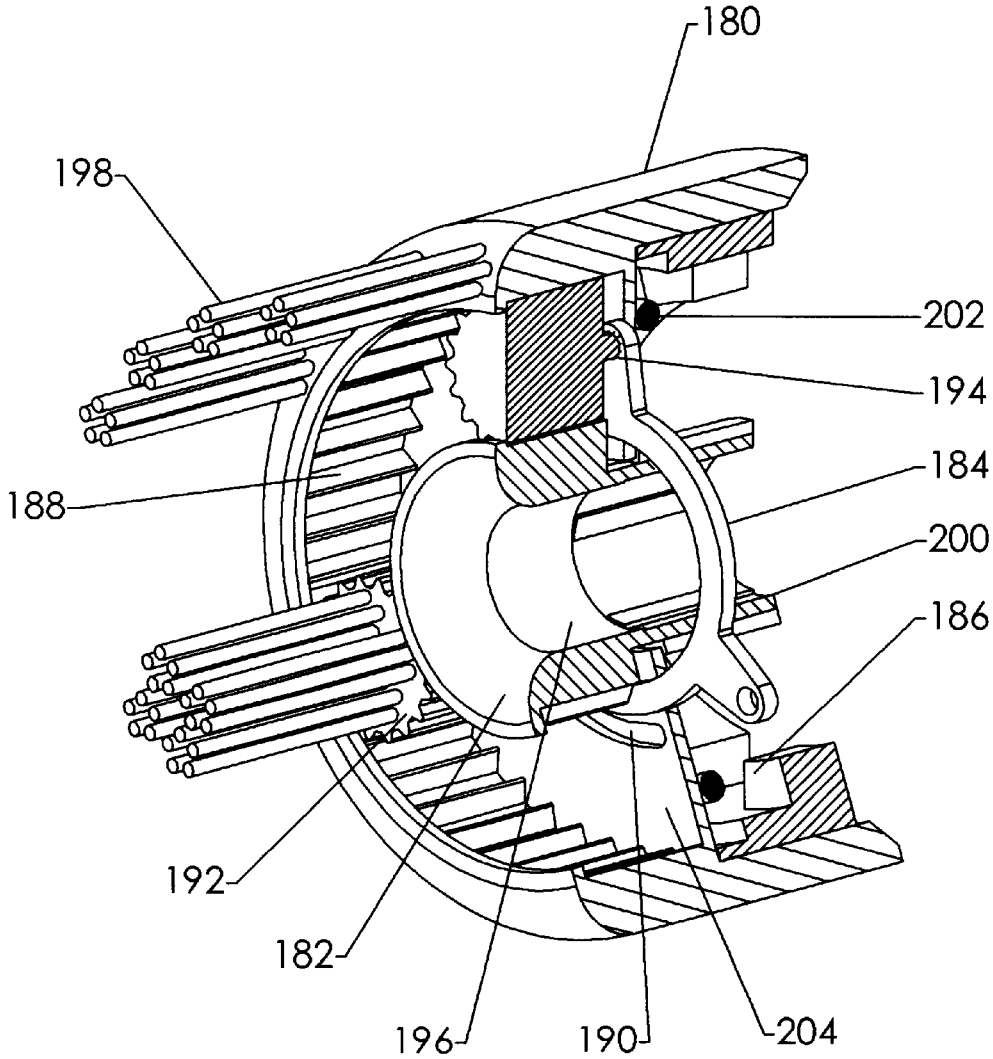
FIG. 5 illustrates yet another rotating detachable accessory constructed in accordance with the principles of the present invention.

Turning now to FIG. 5, a cross sectional view of yet another rotating detachable accessory constructed in accordance with the present invention is shown. Multi-brush head 180 is shown having pinion gear 182, retainer ring 184, key slots 186, ring gear 188, exit slots 190, gears 192, shafts 194, opening 196 and bristles 198.

Multi-brush head 180 is shown having two sections separated by bulk head 204. The attaching section of multi-brush head 180 is shown having key slots 186 and the section having ring gear 188. Similar to key slots 114 (See FIG. 3*a*) key slots 186 are positionally and dimensionally matched to fit snugly with keys 62 (See FIG. 2*a*) to provide a detachable locking action of multi-brush head 180 to output nozzle 60 (See FIG. 2*a*). Accordingly, as output nozzle 60 rotates, multi-brush head 180 and ring gear 188 will rotate at the same RPM.

Pinion gear 182 is shown coupled to and through retainer ring 184. Retainer ring 184 holds shaft 194 of gears 192. Pinion gear 182 is also shown having splines 200 for holding pinion gear 182 in a stationary position while ring gear 188 rotates. Splines 200 will be received and held in place by a well know spline coupler (not shown) located on rinse port 58. As ring gear 188 rotates about pinion gear 182, gears 192 will rotate in the same direction as ring gear 188 and retainer ring 184 will rotate about pinion gear 182. Multi-brush head 180 is shown having only three gears 192, however a plurality of gears may be used.

Pinion gear 182 has an opening 196, which is sized and positioned to allow unrestricted fluid flow from spray ports 70 (See FIG. 2*a*) of rinse port 58. Similarly, exit slots 190 are sized and positioned to allow unrestricted fluid flow from exit ports 66 (See FIG. 2*a*) of output nozzle 60. Multi-brush head is shown with o-ring 202. O-ring 202 is sized and positioned to provide friction such that it prevents linear accessory 140 from rotating while output nozzle 60 rotates.

Bristles 198 are shown securely fixed to ring gear 188 and gears 192 and may have the same characteristics as described above for bristles 108 and bristles 156.

The water powered spray device of the present invention is constructed using ABS plastics or equivalent plastic materials. However, one skilled in the art will readily recognize that different materials may be used if the spray device of the present invention is intended for use in industrial or commercial applications requiring both internal and external resistance to damaging fluids, materials and environments.

What is claimed is:

1. A fluid powered spray device comprising:

a body configured to be held by the hand of a user, said body having an inlet end and an outlet end for the flow of fluid therethrough said inlet end being configured for attachment to a pressurized source of fluid, a rotatable nozzle rotatably attached to said outlet end of said body;

drive means within said body, said drive means being operably connected to said nozzle and powered by said fluid for rotating said nozzle;

a plurality of accessories selectively attachable to said nozzle for rotation therewith;

attachment means for removably attaching said accessories to said rotatable nozzle;

first control means for controlling delivery of said fluid from said inlet end to and through said drive means, to and through said nozzle, and through said accessory when attached to said nozzle, said control means further controlling the rotational speed of said rotating nozzle by varying the rate of fluid flow to said drive means;

a nonrotatable nozzle connected to said outlet end of said body and extending concentrically through said rotatable nozzle; and second control means for controlling delivery of said fluid to said nonrotatable nozzle.

2. The fluid powered spray device of claim 1, wherein said attachment means is comprised of a plurality of keys coupled to said drive means for mating with a plurality of key slots of said accessories.

3. The fluid powered spray device of claim 1 wherein said drive means is further comprised of pressurized fluid trigger means, a plurality of ports for producing fluid jets, a turbine coupled to a transmission, and said rotatable nozzle coupled to said transmission.

4. The fluid powered spray device of claim 3 wherein said pressurized fluid trigger means is further comprised of a variable flow valve coupled to said pressurized source of fluid.

5. The fluid powered spray device of claim 4 wherein said pressurized source of fluid is coupled to a fluid pressure regulator.

6. The fluid powered spray device of claim 3, wherein said ports are comprised of fluid inlets and fluid outlets.

7. The fluid powered spray device of claim 6, wherein the inner diameter of said fluid inlet is larger than the inner diameter of said fluid outlet for increasing the velocity of said fluid as it passes from said fluid inlet to said fluid outlet.

8. The fluid powered spray device of claim 7, wherein said transmission is comprised of a series of planetary gears arranged for providing an increased output torque to said rotatable nozzle.

9. The fluid powered spray device of claim 1, wherein said body is comprised of a reservoir for housing a cleaning agent.

10. The fluid powered spray device of claim 1, wherein said accessories provide linear motion.

11. The fluid powered spray device of claim 1, wherein at least one of said accessories includes an outer rotatable member and a plurality of inner rotatable members.

12. A fluid powered spray device comprising:

a body configured to be held by the hand of a user, said body having an inlet end and an outlet end for the flow of fluid therethrough, said inlet end being configured for attachment to a pressurized source of fluid;

a rotatable nozzle rotatably attached to said outlet end of said body;

drive means within said body, said drive means being operably connected to said nozzle and powered by said fluid for rotating said nozzle;

a plurality of accessories selectively attachable to said nozzle for rotation therewith, wherein said accessories are comprised of an abrasive material section and an open section;

attachment means for removably attaching said accessories to said rotatable nozzle;

first control means for controlling delivery of said fluid from said inlet end to and through said drive means, to and through said nozzle, to and through said abrasive material section when said accessory is attached to said nozzle, said control means further controlling the rotational speed of said rotating nozzle by varying the rate of fluid flow to paid drive means;

a nonrotatable nozzle connected to said outlet end of said body and extending concentrically through said rotatable nozzle;

second control means for controlling delivery of said fluid to said nonrotatable nozzle and through said open section of said accessories;

an agent reservoir for housing a cleaning agent; and mode selection means for selecting a plurality of operation modes.

13. The fluid powered spray device of claim 12, wherein said mode selection means is comprised of a plurality of valves coupled to said drive means and to ports in said accessories and an agent valve coupled to said agent reservoir.

14. The fluid powered spray device of claim 13, wherein said valves coupled to said drive means and said ports are comprised of variable valves for regulating flow of fluid to said drive means and said ports, and wherein said agent valve coupled to said agent reservoir is comprised of a valve having a plurality of fixed positions.

15. The fluid powered spray device of claim 13, wherein said valves coupled to said drive means, said ports and said agent valve are comprised of a plurality of combinations of variable valves of valves having fixed positions.

16. The fluid powered spray device of claim 12, wherein said accessories are comprised of a plurality of fluid ports and removable attachment means.

17. The fluid powered spray device of claim 16, wherein said fluid ports couple said fluid from said drive means to and through said abrasive material.

18. The fluid powered spray device of claim 17, wherein said first control means and said second control means may be operated with one hand of a user.

19. The fluid powered spray device of claim 18, wherein said accessories are powered for both linear and rotating motion.

* * * * *